US006020101A

United States Patent [19]

Sacripante et al.

[11] Patent Number: 6,020,101

[45] Date of Patent: Feb. 1, 2000

[54] TONER COMPOSITION AND PROCESS THEREOF

[75] Inventors: Guerino G. Sacripante; Raj D. Patel, both of Oakville; Walter Mychajlowskij, Mississauga; Daniel A. Foucher, Toronto, all of Canada

[73] Assignee: Xerox Corporation, Stamford, Conn.

[21] Appl. No.: 09/295,524

[22] Filed: Apr. 21, 1999

[51] Int. Cl.[7] ..... G03G 9/087

[52] U.S. Cl. ..... 430/109; 430/137

[58] Field of Search ..... 430/109, 137

[56] References Cited

U.S. PATENT DOCUMENTS

| | | | |
|---|---|---|---|
| 4,954,412 | 9/1990 | Breton et al. | 430/137 |
| 5,593,807 | 1/1997 | Sacripante et al. | 430/137 |
| 5,604,076 | 2/1997 | Patel et al. | 430/137 |
| 5,648,193 | 7/1997 | Patel et al. | 430/137 |
| 5,658,704 | 8/1997 | Patel et al. | 430/137 |
| 5,660,965 | 8/1997 | Mychajlowskij et al. | 430/137 |
| 5,840,462 | 11/1998 | Foucher et al. | 430/137 |
| 5,853,944 | 12/1998 | Foucher et al. | 430/137 |
| 5,916,725 | 6/1999 | Patel et al. | 430/137 |
| 5,945,245 | 8/1999 | Mychajlowskij et al. | 430/137 |

*Primary Examiner*—John Goodrow
*Attorney, Agent, or Firm*—E. O. Palazzo

[57] ABSTRACT

A toner comprised of a core comprised a first resin and colorant, and thereover a shell comprised of a second resin and wherein said first resin is an ion complexed sulfonated polyester resin, and said second resin is a transition metal ion complex sulfonated polyester resin.

27 Claims, No Drawings

TONER COMPOSITION AND PROCESS THEREOF

The present invention is generally directed to toner compositions and processes thereof, and more specifically the present invention relates to the coalescence or fusion of colorant and resin particles, especially polyester colloids of size of for example, from about 5 to about 80 nanameters, and preferably from about 10 to about 40 nanometers as determined by a Nicomp particle sizer. In embodiments, the present invention is directed to the economical in situ, chemical or direct preparation of toners comprised of a resin core, colorant and shell thereover, and wherein the core is comprised of first polyester resin with colorant, and the shell is comprised of a second polyester resin. In a specific embodiment of the present invention there is provided a toner composition comprised of a crosslinked core, obtained for example, by the coalescence of a colorant and a colloidial aqueous solution of a sulfonated polyester, especially a sodio sulfonated polyester resin with a coalscence agent comprised, for example, of divalent salt of the Group II elements, such as magnesium, calcium, berylium, the barium salts of chloride, bromide, iodide, acetate, or alkylate; or forming a core comprised of a colorant and first polyester resin comprised of an alkali (II) ionically complexed sulfonated polyester resin; followed by the formation of a shell comprised of second polyester resin and obtained, for example, by the addition of a colloidial solution of a polyester, especially a sodio sulfonate polyester and a coalescence agent comprised of a metal salt of the transition metals of Groups 3 to 12, such as for example zinc, copper, cadmium, manganese, vanadium, iron, cobalt, chromium, niobium, zirconium, nickel and the like. In embodiments, the toner composites or compositions of the present invention, display an average volume diameter of for example, from about 1 to about 25, and preferably from 1 to about 10 microns and a narrow GSD of, for example, from about 1.16 to about 1.26 or about 1.18 to about 1.28 as measured on the Coulter Counter; low fixing temperatures, for example, of from about 110 to about 130 degrees Centigrade, and wherein the gloss level of a fused image can be controlled by the proper selection of the core and shell. For example, for black or highlight color imaging applications, low gloss levels of from about 0 to about 15 as measured by the known Gardner gloss device can be obtained by utilizing a toner comprised of a first polyester core, such as an alkali (II) ionic complex of a sulfonated polyester resin, and which core is encapsulated by a dissimilar polyester resin complexed ionically with a transition metal and referred to for example, as the second polyester shell. In embodiments, the shell has a thickness of from about 0.1 to about 3 microns. Moreover, for full color applications, such as for example, pictorial color applications, high gloss levels are desired, such as from about 50 to about 90 as measured by the Gardner gloss measuring unit, and which toners can be obtained in accordance with the present invention by selecting a toner comprised of a first polyester core encapsulated by a shell comprised of a second polyester resin. The process of the present invention in embodiments enables the utilization of polymers obtained by polycondensation reactions, such as polyesters, and more specifically, the sulfonated polyesters as illustrated in U.S. Pat. Nos. 5,348,832; 5,658,704 and 5,604,076, the disclosures of which are totally incorporated herein by reference, and which polyesters may be selected for low melting toners.

The resulting toners can be selected for known electrophotographic imaging methods, printing processes, including color processes, digital methods, and lithography.

PRIOR ART

There is illustrated in U.S. Pat. No. 4,954,412, a microsuspension process for the preparation of encapsulated toner compositions, comprised of an olefinic polymer core and a shell comprised of a thermotropic liquid crystalline polyester resin.

Polyester based chemical toners free of encapsulation are also known, reference U.S. Pat. No. 5,593,807, wherein there is disclosed a process for the preparation of a toner comprised of a sodio sulfonated polyester resin and pigment, and wherein the aggregation and coalescence of resin particles is mediated with an alkali halide. Other U.S. Patents that may be of interest, the disclosures of which are totally incorporated herein by reference are; U.S. Pat. Nos. 5,853,944; 5,840,462; 5,604,076; 5,648,193; 5,658,704 and 5,660,965.

The appropriate processes and components of the above patents may be selected for the present invention in embodiments thereof.

SUMMARY OF THE INVENTION

It is a feature of the present invention to provide dry toner compositions comprised of a core and a shell thereover, and wherein the core is comprised of a first polyester resin, and colorant and the shell is comprised of a second polyester resin, and which toner may also include toner additives thereover, that is preferably on the shell, such as charge additives, surface additives and the like.

In another feature of the present invention there are provided simple and economical chemical processes for the stepwise preparation of a toner compositions with, for example, a core and shell morphology, comprised of a first polyester and colorant, and a second polyester resin thereover.

In a further feature of the present invention there is provided a simple sequential, such as a stepwise process for the preparation of toner size particles in the size range of from about 3 to about 7 microns with a narrow GSD in the range of from about 1.18 to about 1.26, and wherein the toner particles are comprised of a core comprised of a colorant and first polyester resin, and a shell thereover comprised of a second polyester resin.

Also, in another feature of the present invention there is provided a process for the preparation of toner compositions with an average particle volume diameter of from between about 1 to about 20 microns, and preferably from about 1 to about 9 microns, and with a narrow GSD of from about 1.12 to about 1.30, and preferably from about 1.14 to about 1.25 as measured by a Coulter Counter.

Moreover, in another feature of the present invention there is provided a core and shell composite toner, and wherein the core is comprised of a colorant and a first polymeric resin, and the shell is comprised of an second dissimilar polyester resin.

In yet another feature of the present invention there are provided toner compositions with low fusing temperatures of from about 110° C. to about 130° C. and with excellent blocking characteristics at from about 50° C. to about 60° C., and preferably from about 55 to about 60° C.

Moreover, in another feature of the present invention there are provided toner compositions with a high projection efficiency, such as from about 75 to about 95 percent efficiency as measured by the Match Scan II spectrophotometer available from Milton-Roy.

In a further feature of the present invention there are provided toner composition which result in minimal, low or no paper curl.

Moreover, in another feature of the present invention there are provided toner compositions with variable gloss, such as from about 1 to about 90 as measured by the Gardner Gloss metering unit.

Aspects of the present invention relate to a toner comprised of a core comprised a first resin and colorant, and thereover a shell comprised of a second resin and wherein said first resin is an ion complexed sulfonated polyester resin, and said second resin is a transition metal ion complex sulfonated polyester resin; a toner wherein said first resin is present in an amount of from about 40 to about 90 percent by weight of toner, and the second resin is present in an amount of from about 10 to about 55 percent by weight of toner and wherein the shell encapsulates said core; a toner, wherein the first resin is of the formula

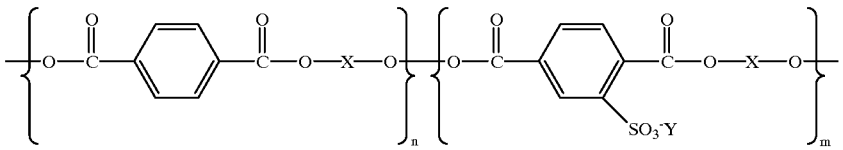

wherein Y is an alkali metal or alkaline metal such as for example a monovalent alkali metal or divalent alkaline earth metal, X is a glycol, and n and m represent the number of segments; a toner, wherein the second resin is a transition metal ion complex of the formula;

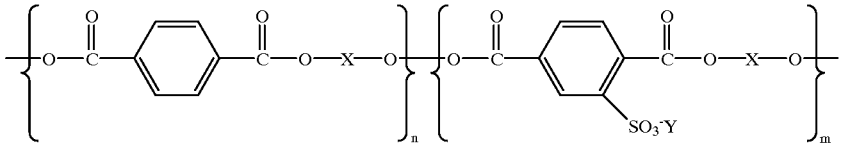

wherein Y is transition metal of, for example, a monovalent or multivalent ion of scandium, yttrium, lutertium, titanium, zirconium, hafnium, vanadium, chromium, niobium, tantalum, molybdenum, tungsten, manganese, rhenium, iron, ruthenium, osmium, cobalt, rhodium, iridium, nickel, paladium, copper, platinum, silver, gold, zinc, cadmuim, mercury, aluminum, or mixtures thereof; a toner wherein the glycol is neopentyl glycol, ethylene glycol, propylene glycol, butylene glycol, propanediol, diethylene glycol, or mixtures thereof; a toner, wherein said Y alkali is magnesium; a toner wherein said Y metal is zinc; a toner wherein the colorant is a cyan, black, magenta, yellow dispersion or mixtures thereof with from about 20 to about 60 weight percent solids of colorant; a toner wherein said colorant is carbon black; a toner wherein said colorant is a dye; a toner wherein said colorant is a pigment; a toner wherein said colorant is comprised of a mixture of a pigment and a dye; a toner wherein said first resin is the magnesium salt of copoly (1,2-propylene-dipropylene-5-Sulfoisophtalate)-copoly (1,2-propylene-dipropylene terephthalate), the magnesium salt of copoly (1,2-propylene-diethylene-5-Sulfoisophtalate)-copoly (1,2-propylene-diethylene terephthalate), the calcium salt of copoly (1,2-propylene-dipropylene-5-Sulfoisophtalate)-copoly (1,2-propylene-dipropylene terephthalate), or the barium salt of copoly (1,2-propylene-diethylene-5-Sulfoisophtalate)-copoly (1,2-propylene-diethylene terephthalate); a toner wherein said second resin is the zinc salt of copoly (1,2-propylene-diethylene-5-Sulfoisophtalate)-copoly (1,2-propylene-diethylene terephthalate), the zince salt of copoly (1,2-propylene-diethylene-5-Sulfoisophtalate)-copoly (1,2-propylene-diethylene terephthalate), the vanadium salt of copoly (1,2-propylene-dipropylene-5-Sulfoisophtalate)-copoly (1,2-propylene-dipropylene terephthalate), or the copper salt of copoly (1,2-propylene-diethylene-5-Sulfoisophtalate)-copoly (1,2-propylene-diethylene terephthalate); a toner wherein said toner contains in the shell additives comprised of metal salts, metal salts of fatty acids, colloidal silicas, metal oxides, or mixtures thereof which additives are each optionally present in an amount of from about 0.1 to about 2 weight percent; a toner wherein said glycol, is an aliphatic glycol of neopentyl glycol, ethylene glycol, propylene glycol, butylene glycol, pentylene glycol, propanediol, 1,2-propanediol, diethylene glycol, or mixtures thereof; and n and m represent each is about 10 to about 30 each, and wherein the weight average molecular weight of said polyester is from about 2,000 grams per mole to about 100,000 grams per mole, the number average molecular weight is from about 1,000 grams per mole to about 50,000 grams per mole, and the polydispersity thereof is from about 2 to about 18 as measured by gel permeation chromatography; a toner wherein said first resin is the magnesium salt of copoly (1,2-propylene-dipropylene-5-sulfoisophtalate)-copoly (1,2-propylene-dipropylene terephthalate); a toner wherein said second resin is the zinc salt of copoly (1,2-propylene-diethylene-5-Sulfoisophtalate)-copoly (1,2-propylene-diethylene terephthalate); a toner comprised of a resin core and colorant, and a resin shell and wherein said core resin is an alkali polyester resin, and said resin shell is a transition metal polyester resin; a toner wherein said core resin is an alkali complexed sulfonated polyester and said resin shell is a transition metal ion complex of a sulfonated polyester resin; a toner comprised of a core comprised a first resin and colorant, and a second resin shell wherein said first resin is of the formula

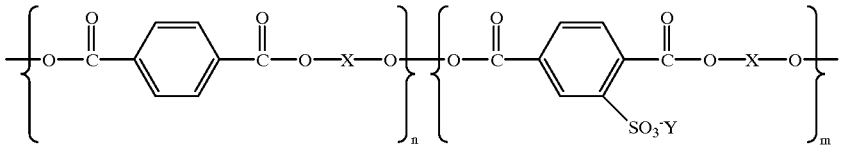

wherein Y is an alkali metal, X is a glycol, and n and m represent the number of segments, and said second said resin is a transition metal ion complex sulfonate polyester resin.

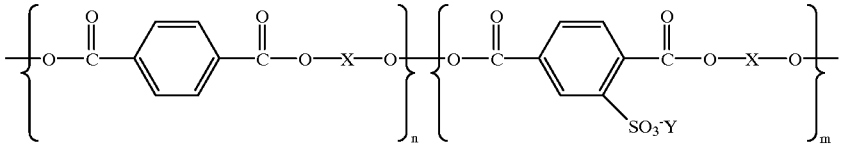

and wherein Y is a monovalent transition metal, or a divalent transition metal, x is a glycol and n and m represent the number of segments; a toner wherein the toner particle size is from about 3 to about 15 microns in volume average diameter; a toner wherein said Y alkali metal is a magnesium ($Mg^{++}$), berylium ($Be^{++}$), calcium ($Ca^{++}$) or Barium ($Ba^{++}$); and wherein each n and m is a number of from about 10 to about 30, and wherein the weight average molecular weight thereof of said core resin is from about 2,000 grams per mole to about 100,000 grams per mole, the number average molecular weight is from about 1,000 grams per mole to about 50,000 grams per mole, and the polydispersity is from about 2 to about 18 as measured by gel permeation chromatography; a toner wherein X is aliphatic glycol of neopentyl glycol, ethylene glycol, propylene glycol, butylene glycol, pentylene glycol, propanediol, 1,2-propanediol, diethylene glycol, or mixtures thereof; a toner process comprising (I) admixing a colloidal solution of a sodio sulfonated polyester resin, and colorant; and adding thereto an aqueous solution containing an alkali (II) salt of said polyester resin and optionally cooling and optionally adding to said toner wax, charge additive, and surface flow additives; a toner process comprising (I) preparing a colloidal solution of a sodio sulfonated polyester resin by heating said solution at a temperature of from about 75 to about 95 degrees Centigrade; adding thereto a sodio sulfonated polyester; cooling; adding thereto a colorant, followed by heating the resulting mixture and adding thereto an aqueous solution containing an alkali (II) salt; adding a further amount of colloidial sulfonated polyester resin, followed by the addition of an aqueous solution of a transition metal salt solution; isolating said toner resulting, and drying said toner; a process wherein said toner is isolated, filtered, washed with water, and dried; a process comprised of (i) heating a mixture of a colorant and an aqueous solution of a polyester, especially a sodio sulfonated polyester colloid with a particle size of from about 10 to about 80 nanonmeters, and preferably from about 10 to about 40 nanometers; (ii) heating the resulting mixture to a suitable temperature of for example, about 45 to about 60 degrees Centigrade and adding thereto an aqueous solution of an alkali (II) salt such as magnesium chloride and thereby forming a core particle comprised of a colorant and first resin comprised of an ionically complexed alkali (II) sulfonated polyester, with a particle size of from about 2 to about 7 microns in volume average diameter as measured by the Coulter Counter; and (iii) adding thereto an aqueous solution containing about 10 to about 35 Percent by weight of sodio sulfonated polyester resin colloid, and an aqueous solution containing from about 1 to about 10 percent by weight of coalescence agent comprised of a metal salt of the transition metals of Groups III to XII, such as for example, the chloride, acetate, or sulfates of zinc, copper, cadmium, manganese, vanadium, nickel, niobium, chromium, iron, zirconium, scandium and the like, and a process comprising a first coalescence of an aqueous dispersion of a sodio sulfonated polyester colloid and colorant particles with an alkali (II) salt, such as for example magnesium acetate, followed thereafter by a second coalescence of the aforementioned core particles and a sodio sulfonated polyester colloid and a coalescence agent comprised of a metal salt of the transition metals of Groups III to XII, such as for example, the chloride, acetate, or sulfates of zinz, scandium and the like.

In a specific embodiment the present invention relates to a toner comprised of a core comprised of a first polyester resin and colorant, encapsulated thereof with a shell comprised of a second polyester resin, and wherein the toner is prepared by (i) generating a colloidial solution of a sodio sulfonated polyester resin, present for example, in an amount of from about 500 grams in 2 liters of water by heating the mixture at for example, from about 20° C. to about 40° C. above the polyester polymer glass transition, and thereby forming a colloidial solution of submicron particles in the size range of, for example, from about 5 to about 40 nanometers; (ii) adding thereto a colorant such Pigment Blue 15:3, available from Sun chemicals, in an amount of for example, from about 3 to about 5 percent by weight of toner; (iii) heating the mixture to a temperature of from about 50 to about 56° C., and adding thereto an aqueous solution of an alkali salt, such as magnesium acetate (for example, at 2 percent by weight in water), at a rate of from about 1 to about 2 mL per minute, whereby the colascence and ionic complexation of polyester colloid and colorant occur until the particle size of the core composite is for example, from about 3 to about microns in diameter (volume average throughout unless otherwise indicated or inferred) with a geometric distribution of from about 1.15 to about 1,.23 as measured by the Coulter Counter; (iv) adding thereto a colloidial solution of a sulfonated polyester resin, for example, of from about 10 to about 25 percent by weight of toner, followed by the addition of an alkali salt, such as for example, magnesium acetate (for example, at 5% percent by weight in water), at a rate of from about 2 to about 4 mL per minute, thereby resulting in the coalescence of the polyester colloid onto the core composite and forming thereover a second polyester resin shell; followed by (v) cooling the reaction mixture to about room temperature, filtering, washing and drying to provide a toner comprised of a core comprised of a colorant and a first polyester resin, and thereover a shell comprised of a second polyester resin, and wherein the particle size of the toner composite is from about 3 to about 6 microns in diameter with a geometric distribution of from about 1.15 to about 1.23 as measured by the Coulter Counter.

The polyester, is preferably a sodio sulfonated polyester resin as illustrated in for example, U.S. Pat. Nos. 5,348,832; 5,853,944; 5,840,462; 5,660,965; 5,658,704; 5,648,193; and 5,593,807; the disclosures of each patent being totally incorporated herein by reference, and for example, wherein the polyester is of the formula

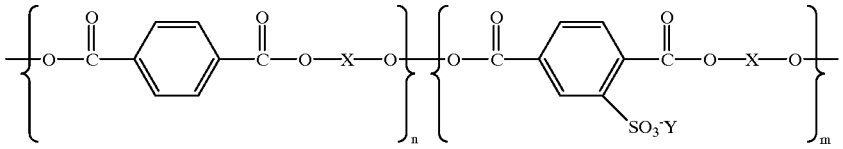

wherein Y is an alkali metal for the first polyester, such as sodium; X is a glycol, such as an aliphatic glycol with for example, from about 2 to about 12 carbons, such as neo-

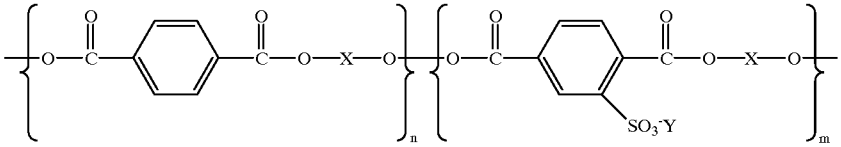

pentyl glycol, ethylene glycol, propylene glycol, butylene glycol, pentylene glycol, and propanediol, and especially 1,2-propanediol, diethylene glycol, or mixtures thereof; and n and m represent the number of segments and each is for example a number of about 5 to about 50, and preferably from about 10 to 30, and wherein the weight average molecular weight of the polyester is for example, from about 2,000 grams per mole to about 100,000 grams per mole, and preferably from about 4,000 to about 70,000 grams per mole, the number average molecular weight is from about 1,000 grams per mole to about 50,000 grams per mole, and preferably from about 2,000 to about 20,000 grams per mole and the polydispersity thereof is for example, from about 2 to about 18, and preferably from about 2 to about 7, as measured by gel permeation chromatography. The resin is then heated in water to a temperature of for example, from about 75 to about 95 degrees Centigrade with stirring to form an aqueous dispersion of the sodio sulfonated polyester resin colloid in water, with a colloidiat solids content of from about 5 to about 35 percent by weight of water, and preferably from about 12 to about 20 percent by weight of water.

The alkali (II) salts that can be selected to coalesce the generated sodio sulfonated polyester colloid with a colorant to enable the formation of the core composite are preferably selected from the akali (II) groups such as beryllium chloride, beryllium bromide, beryllium iodide, berylium acetate, berylium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontioum acetate, strontium sulfate, barium chloride, barium bromide, barium iodide, or mixtures thereof, and the concentration thereof is in the range of for example, from about 0.1 to about 5 weight percent of water. It is believed that the divalent alkali (II) metal ion exchanges with the monovalent sodium ion of the sulfonated polyester resin colloid, thus coalescing the colloidial particles, and wherein the formula of the first polyester resin is wherein Y is an alkali (II) metal, such as a magnesium ($Mg^{++}$), berylium ($Be^{++}$), calcium ($Ca^{++}$); X is a glycol, such as an aliphatic glycol, or mixture of glycols, such as neopentyl glycol, ethylene glycol, propylene glycol, butylene glycol, pentylene glycol, propanediol, especially 1,2-propanediol, diethylene glycol, or mixtures thereof; and n and m represent the number of segments and is about 10 to about 30 each, and wherein the weight average molecular weight is from about 2,000 grams per mole to about 100,000 grams per mole, the number average molecular weight is from about 1,000 grams per mole to about 50,000 grams per mole, and the polydispersity is from about 2 to about 18 as measured by gel permeation chromatography.

Examples of transition metal salts that can be selected to coalesce the sodio sulfonated polyester colloid to form a second polyester resin shell, are preferably selected from the halides such as chloride, bromide, iodide, or anioins such as actetates, acetoacetates, sulfates of vanadium, niobium, tantalum, chromium, molybdenum, tungsten, mangenese, iron, ruthenium, cobalt, nickel, copper, zinc, cadmium, silver; aluminum salts such as aluminum acetate, aluminum polyaluminum chloride, aluminum halides, mixture thereof and the like, and wherein the concentration thereof is optionally in the range of from about 0.1 to about 5 weight percent by weight of water. It is believed, while not be desired to be limited by theory throughout that the transition metal ion exchanges with the monovalent sodium ion of the sulfonated polyester resin colloid, thus coalescing the colloidial particles, and wherein the formula of the second polyester shell resin is illustrated as in the above formula, and wherein Y is preferably zinc ($zn^{++}$), vanadium ($V^{+++}$), or multivalent ions of niobium tantalum, chromium, molybdynum, tungsten, mangenese, iron, ruthenium, cobalt, nickel, copper, zinc, cadmium, silver, aluminum ($Al^{+++}$), in an amount of from about 0.1 to about 10 weight percent of the toner components, and preferably from about 0.5 to about 5 weight percent of the toner.

Polyester examples are as indicated here and in the appropriate U.S. patents recited and more specifically examples of a number of polyesters are the berylium salt of copoly (1,2-propylene-dipropylene-5-Sulfoisophtalate)-copoly (1,2-propylene-dipropylene terephthalate), the barium salt of copoly (1,2-propylene-diethylene-5-Sulfoisophtalate)-copoly (1,2-propylene-diethylene terephthalate), the magnesium salt of copoly (1,2 dipropylene-5-Sulfoisophtalate)-copoly (1,2-propylene terephthalate), the magnesium salt of copoly (1,3-butylene-5-sulfoisophtalate)-copoly (1,3-butylene terephthalate), the calciurm salt of copoly (1,2 dipropylene-5-sulfoisophtalate)-copoly (1,2-propylene terephthalate), the calcium salt of copoly (1,3-butylene-5-Ssulfoisophtalate)-copoly (1,3-butlene terephthalate), the cobalt salt of copoly (1,2-propylene- diethylene-5-sulfoisophtalate)-copoly (1,2-propylene-diethylene terephthalate), the nickel salt of copoly (1,2 dipropylene-5-sulfoisophtalate)-copoly (1,2-propylene terephthalate), the iron salt of copoly (1,3-butylene-5-sulfoisophtalate)-copoly (1,3-butylene terephthalate), the zirconium salt of copoly (1,2 dipropylene-5-Sulfoisophtalate)-copoly (1,2-propylene terephthalate), the chromium salt of copoly (1,3-butylene-5-Sulfoisophtalate)-copoly (1,3-butylene terephthalate) and the like.

Various known colorants, especially pigments, present in the toner in an effective amount of, for example, from about 1 to about 65, preferably from about 2 to about 35 percent by weight of the toner, and more preferably in an amount of from about 1 to about 15 weight percent, include carbon black like REGAL 330®; magnetites, such as Mobay magnetites MO8029™, MO8060™; and the like. As colored pigments, there can be selected known cyan, magenta, yellow, red, green, brown, blue or mixtures thereof. Specific examples of colorants, especially pigments, include phthalocyanine HELIOGEN BLUE L6900™, D6840™, D7080™, D7020™, cyan 15:3, magenta Red 81:3, Yellow 17, the pigments of U.S. Pat. No. 5,556,727, the disclosure of which is totally incorporated herein by reference, and the like. Examples of specific magentas that may be selected include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of specific cyans that may be selected include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative specific examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The colorants, such as pigments, selected can be flushed pigments as indicated herein.

More specifically, colorant examples include Pigment Blue 15:3 having a Color Index Constitution Number of 74160, magenta Pigment Red 81:3 having a Color Index Constitution Number of 45160:3, and Yellow 17 having a Color Index Constitution Number of 21105, and known dyes such as food dyes, yellow, blue, green, red, magneta dyes, and the like. Colorants include pigments, dyes, mixtures of pigments, mixtures of dyes, and mixtures of dyes and pigments, and the like, and preferably pigments.

The toner may also include known charge additives in effective amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, negative charge enhancing additives like aluminum complexes, and the like.

Surface additives that can be added to the toner compositions preferably after washing or drying include, for example, metal salts, metal salts of fatty acids, colloidal silicas, metal oxides like titanium, tin and the like, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and flow aids, such as fumed silicas like AEROSIL R972® available from Degussa, or silicas available from Cabot Corporation or Degussa Chemicals, each in amounts of from 0.1 to 2 percent, which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos.

4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,990, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated.

EXAMPLE I

PREPARATION OF SODIO SULFONATED POLYESTERS

A linear sulfonated random copolyester resin comprised of, on a mol percent, 0.465 of terephthalate, 0.035 of sodium sulfoisophthalate, 0.475 of 1,2-propanediol, and 0.025 of diethylene glycol was prepared as follows. In a 5 gallon Parr reactor equipped with a bottom drain valve, double turbine agitator, and distillation receiver with a cold water condenser were charged 3.98 kilograms of .dimethylterephthalate, 451 grams of sodium dimethyl sulfoisophthalate, 3.104 kilograms of 1,2-propanediol (1 mole excess of glycol), 351 grams of diethylene glycol (1 mole excess of glycol), and 8 grams of butyltin hydroxide oxide catalyst. The reactor was then heated to 165° C. with stirring for 3 hours whereby 1.33 kilograms of distillate were collected in the distillation receiver, and which distillate was comprised of about 98 percent by volume of methanol and 2 percent by volume of 1,2-propanediol as measured by the ABBE refractometer available from American Optical Corporation. The reactor mixture was then heated to 190° C. over a one hour period, after which the pressure was slowly reduced from atmospheric pressure to about 260 Torr over a one hour period, and then reduced to 5 Torr over a two hour period with the collection of approximately 470 grams of distillate in the distillation receiver, and which distillate was comprised of approximately 97 percent by volume of 1,2-propanediol and 3 percent by volume of methanol as measured by the ABBE refractometer. The pressure was then further reduced to about 1 Torr over a 30 minute period whereby an additional 530 grams of 1,2-propanediol were collected. The reactor was then purged with nitrogen to atmospheric pressure, and the polymer product discharged through the bottom drain onto a container cooled with dry ice to yield 5.60 kilograms of 3.5 mol percent sulfonated polyester resin, sodio salt of (1,2-propylene-dipropylene-5-sulfoisophtalate)-copoly (1,2-propylene-dipropylene terephthalate). The sulfonated polyester resin glass transition temperature was measured to be 56.6° C. (onset) utilizing the 910 Differential Scanning Calorimeter available from E. I. DuPont operating at a heating rate of 10° C. per minute. The number average molecular weight was measured to be 3,250 grams per mole, and the weight average molecular weight was measured to be 5,290 grams per mole using tetrahydrofuran as the solvent.

Preparation of a Sodio Sulfonated Polyester Colloid solution:

A 12 percent of aqueous colloidial sulfonate polyester resin was prepared by first heating about 2 liters of water to about 85 degrees Centigrade with stirring, and adding thereto 240 grams of the sulfonated polyester resin obtained above, followed by continued heating at about 85° C., and stirring of the mixture for a duration of from about one to about two hours, followed by cooling to about room temperature, about 25 degrees Centigrade throughout the Examples. The colloid had a characteristic blue tinge and particle sizes in the range of from about 5 to about 150 nanometers as measured by the Nicomp particle sizer.

EXAMPLE II

A 6 Micron Cyan Toner Comprised of a First Polyester Core Resin and Pigment Blue 15:3, and a Shell Comprised of a Second Polyester Resin.

A 2 liter colloidial solution of containing 12 percent by weight of the sodio sulfonated polyester resin of Example I, was charged into a 4 liter kettle equipped with a mechanical stirrer. To this was added 32 grams of a dispersion containing 30 percent by weight of Pigment Blue 15:3 (available from Sun Chemicals), and the resulting mixture was heated to 52° C. with stirring at about 180 to 200 revolutions per minute. To this heated mixture, was then added dropwise 400 grams of an aqueous solution containing 5 percent by weight of magnesium acetate. The dropwise addition of the acetate salt solution was accomplished utilizing a pump, at a rate of addition was set at approximately 3 milliliters per minute. After the addition was complete (about 2.5 hours), the kettle temperature was raised to about 54 degrees Centigrade and maintained at this temperature for an additional 3 hours. A sample (about 2 grams) of the reaction mixture was then retrieved from the kettle, and a particle size of 2.6 microns with a GSD of 1.23 was measured by the Coulter Counter. To this mixture was then added 333 grams of the colloidial solution of Example 1A and containg 12 percent by weight of the sodio sulfonated polyester resin of Example I, followed by the dropwise addition of 20 grams of an aqueous solution containing 1 percent by weight of zinc acetate, via a pump at a rate of about 2 milliliters per minute. The temperature of the kettle was then raised to 56° C., and maintained at 56 degrees Centigrade for an additional 2 hours at a stirring rate of about 180 to 200 revolutions per minute. The mixture was then allowed to cool to room temperature, about 25 degrees Centigrade, overnight, about 18 hours, (with stirring). The product was filtered off, washed twice with deionized water, and freeze dried to afford 270 grams of cyan toner, with a particle size of 6.0 microns and a GSD of 1.21, as measured by the Coulter Counter. The toner resulting was comprised of a core comprised of 3.3 weight percent of pigment Blue 15:3 and 83% by weight of the first polyester core resin of the magnesium salt complex of copoly (1,2-propylene-dipropylene-5-sulfoisophtalate)-copoly (1,2-propylene-dipropylene terephthalate), and 13.7% by weight of a shell, believed to be from about 0.1 to about 0.5 microns in thickness, and comprised of a second polyester resin of the zinc salt of copoly (1,2-propylene-dipropylene-5-Sulfoisophtalate)-copoly (1,2-propylene-dipropylene terephthalate).

EXAMPLE III

A 6.1 Micron Cyan Toner Cmprised of a First Polyester Core Resin and Pigment Blue 15:3, and a Shell Comprised of a Second Polyester Resin.

A 1 liter colloidial solution of containing 12 percent by weight of sodio sulfonated polyester resin of Example I, was charged into a 4 liter kettle equipped with a mechanical stirrer. To this was added 32 grams of a dispersion containing 30 percent by weight of Pigment Blue 15:3 (available from SUN Chemicals), and the resulting mixture was heated to 52° C. with stirring at about 180 to 200 revolutions per minute. To this heated mixture, was then added dropwise 200 grams of an aqueous solution containing 1 percent by weight of magnesium acetate. The dropwise addition of the above salt solution was accomplished utilizing a pump, and the rate of addition was set at approximately 2 milliliters per minute After the addition was complete (about 2 hours), the kettle temperature was raised to about 54 degrees Centigrade and maintained at this temperature for an additional 3 hours. A sample (about 2 grams) of reaction mixture was then retrieved from the kettle, and a particle size of 3 microns with a GSD of 1.23 was measured by the Coulter Counter. To this mixture was then added 1,333 grams of colloidial solution containing 12 percent by weight of the sodio sulfonated polyester resin of Example I, followed by the dropwise addition of 200 grams of an aqueous solution containing 5 percent by weight of zinc acetate, via a pump at a rate of about 3 milliliters per minute. The temperature of the kettle was then raised to 56° C., and maintained at 56 for an additional 2 hours at a stirring rate of about 180 to 200 revolutions per minute. The mixture was then allowed to cool to room temperature overnight in accordance with Example II. The product was filtered off, washed twice with deionized water, and freeze dried to afford 265 grams of cyan toner, with a particle size of 6.1 microns with a GSD of 1.20, as measured by the Coulter Counter. The toner was comprised of 3% by weight of Pigment Blue 15:3, 42% by weight of a first polyester core resin of magnesium salt complex of copoly (1,2-propylene-dipropylene-5-Sulfoisophtalate)-copoly (1,2-propylene-dipropylene terephthalate), and 55% by weight of a shell comprised of a second polyester resin of the zinc salt of copoly (1,2-propylene-dipropylene-5-Sulfoisophtalate)-copoly (1,2-propylene-dipropylene terephthalate).

EXAMPLE IV

A 6.3 Micron Cyan Toner Comprised of 41.7% by Weight of Polyester Core Resin and 3.3% Pigment Blue 15:3, and 55% by Weight of Shell Comprised of a Second Polyester Resin.

A 1.5 liter colloidial solution of containing 12 percent by weight of the sodio sulfonated polyester resin of Example I, was charged into a 4 liter kettle equipped with a mechanical stirrer. To this was added 32 grams of a dispersion containing 30 percent by weight of Pigment Blue 15:3 (available from Sun Chemicals), and the mixture was heated to 52° C. with stirring at about 180 to 200 revolutions per minute. To this heated mixture, was then added dropwise 300 grams of an aqueous solution containing 5 percent by weight of magnesium acetate. The dropwise addition of the acetate salt solution was accomplished utilizing a pump, and the rate of addition was set at approximately 3 milliliters per minute. After the addition was complete (about 2.5 hours), the kettle temperature was raised to about 54 degrees Centigrade and maintained at 54 for an additional 3 hours. A sample (about 2 grams) of the reaction mixture was then retrieved from the kettle, and a particle size diameter of 2.7 microns with a GSD of 1.22 was measured by the Coulter Counter. To this mixture was then added 833 grams of a colloidial solution containing 12 percent the adropwise addition of 80 grams of an aqueous solution containing 1 percent by weight of zinc acetate, via a pump at a rate of about 2 milliliters per minute. The temperature of the kettle was then raised to 56° C., and maintained at 56 for an is additional 2 hours at a stirring rate of about 180 to 200 revolutions per minute. The mixture was then allowed to cool to room temperature overnight in accordance with Example III. The product was filtered off, washed twice with deionized water, and freeze dried to afford 270 grams of a cyan toner, with a particle size diameter of 6.3 microns and a GSD of 1.21, as measured by the Coulter Counter. The toner product was comprised of 3.3% by weight of Pigment Blue 15:3, of 41.7% by weight of a first polyester core resin of the magnesium salt complex of copoly (1,2-propylene-dipropylene-5-Sulfoisophtalate)-copoly (1,2-propylene-dipropylene terephthalate), and 55% by weight of shell comprised of a second polyester resin of the zinc salt of copoly (1,2-propylene-dipropylene-5-Sulfoisophtalate)-copoly (1,2-propylene-dipropylene terephthalate).

EXAMPLE V

A 6 Micron Cyan Toner Comprised of 62.2% by Weight First Polyester Core Resin and 3.3% Pigment Blue 15:3, and 34.5% by Weight of Shell Comprised of a Second Polyester Resin.

A 1.5 liter colloidial solution containing 12 percent by weight of the sulfonated polyester resin of Example I, was charged into a 4 liter kettle equipped with a mechanical stirrer. To this was added 32 grams of a dispersion containing 30 percent by weight of Pigment Blue 15:3 (available from Sun Chemicals), and the mixture was heated to 52° C. with stirring at about 180 to 200 revolutions per minute. To this heated mixture, was then added dropwise 300 grams of an aqueous solution containing 1 percent by weight of magnesium acetate. The dropwise addition of the acetate salt solution was accomplished utilizing a pump, and the rate of addition was set at approximately 2 milliliters per minute. After the addition was complete (about 2 hours), the kettle temperature was raised to about 54 degrees Centigrade and maintained at 54 for an additional 3 hours. A sample (about 2 grams) of the reaction mixture was then retrieved from the kettle, and a particle size of 3.1 microns with a GSD of 1.23 was measured by the Coulter Counter. To this mixture was then added 833 grams of a colloidial solution containing 12 percent by weight of the sodio sulfonated polyester resin of Example I, followed by a dropwise addition of 300 grams of an aqueous solution containing 5 percent by weight of zinc acetate, via a pump at a rate of about 3 milliliters per minute. The temperature of the kettle was then raised to 56° C., and maintained at 56 for an additional 2 hours at a stirring rate of about 180 to 200 revolutions per minute. The mixture was then allowed to cool to room temperature overnight as accomplished in Example III. The product was filtered off, washed twice with deionized water, and freeze dried to afford 265 grams of toner, with a diameter particle size of 6.0 microns and a GSD of 1.20, as measured by the Coulter Counter. The toner was comprised of 3.3% by weight of Pigment Blue 15:3, 62.2% by weight of a first polyester core resin of the magnesium salt complex of copoly (1,2-propylene-dipropylene-5-Sulfoisophtalate)-copoly (1,2-propylene-dipropylene terephthalate), and 34.5% by weight of shell comprised of a second polyester resin of the zinc salt of copoly (1,2-propylene-dipropylene-5-Sulfoisophtalate)-copoly (1,2-propylene-dipropylene terephthalate).

EXAMPLE VI

A 5 Micron Cyan Toner Comprised of 62.2% by Weight First Polyester Core Resin and 3.3% Pigment Blue 15:3, and 34.5% by Weight of Shell Comprised of a Second Polyester Resin.

A 1.5 liter colloidial solution containing 12 percent by weight of the sulfonated polyester resin of Example I, was charged into a 4 liter kettle equipped with a mechanical stirrer. To this was added 32 grams of a dispersion containing 30 percent by weight of Pigment Blue 15:3 (available from Sun Chemicals), and the mixture was heated to 52° C. with stirring at about 180 to 200 revolutions per minute. To this heated mixture, was then added dropwise 260 grams of an aqueous solution containing 1 percent by weight of calcium acetate. The dropwise addition of the acetate salt solution was accomplished utilizing a pump, and the rate of addition was set at approximately 2 milliliters per minute. After the addition was complete (about 2 hours), the kettle temperature was raised fo about 54 degrees centigrade and maintained at 54 for an additional 3 hours. A sample (about 2 grams) of the reaction mixture was then retrieved from the kettle and a particle size of 3.0 microns with a GSD of 1.22 was measured by the Coulter Counter. To this mixture was then added 833 grams of a colloidial solution of containing 12 percent by weight of the sodio sulfonated polyester resin of Example I, followed by a dropwise addition of 300 grams of an aqueous solution containing 5 percent by weight of copper (II) sulfate, via a pump at a rate of about 3 milliliters per minute. The temperature of the kettle was then raised to 56° C., and maintained at 56 for an additional 2 hours at a stirring rate of about 180 to 200 revolutions per minute. The mixture was then allowed to cool to room temperature overnight as in Example III. The product was filtered off, washed twice with deionized water, and freeze dried to afford 265 grams of toner, with a particle size of 5.0 microns with a GSD of 1.24, as measured by the Coulter Counter. The toner was comprised of 3.3% by weight of Pigment Blue 15:3 (part of the core throughout), 62.2% by weight of the first polyester core resin of the calcium salt complex of copoly (1,2-propylene-dipropylene-5-Sulfoisophtalate)-copoly (1,2-propylene-dipropylene terephthalate), and 34.7% by weight of shell comprised of a second polyester resin of the copper salt of copoly (1,2-propylene-dipropylene-5-sulfoisophtalate)-copoly (1,2-propylene-dipropylene terephthalate).

EXAMPLE VII

A 5.5 Micron Cyan Toner Comprised of 62.2% by Weight First Polyester Core Resin and 3.3% Pigment Blue 15:3, and 34.5% by Weight of Shell Comprised of a Second Polyester Resin.

A 1.5 liter colloidial solution of containing 12 percent by weight of the sulfonated polyester resin of Example I, was charged into a 4 liter kettle equipped with a mechanical stirrer. To this was added 32 grams of a dispersion containing 30 percent by weight of Pigment Blue 15:3 (available from Sun Chemicals), and the mixture was heated to 52° C. with stirring at about 180 to 200 revolutions per minute. To this heated mixture, was then added dropwise 280 grams of an aqueous solution containing 1 percent by weight of berylium acetate. The dropwise addition of the berylium salt solution was accomplished utilizing a pump, and the rate of addition was set at approximately 2 milliliters per minute. After the addition was complete (about 2 hours), the kettle temperature was raised to about 54 degrees Centigrade and maintained at 54 for an additional 3 hours. A sample (about 2 grams) of the reaction mixture was then retrieved from the kettle, and a particle size of 2.8 microns with a GSD of 1.24 was measured by the Coulter Counter. To this mixture was then added 833 grams of a colloidial solution of containing 12 percent by weight of the sodio sulfonated polyester resin of Example I, followed by a dropwise addition of 300 grams of an aqueous solution containing 5 percent by weight of vanadyl acetoacetate, via a pump at a rate of about 3 milliliters per minute. The temperature of the kettle was then raised to 56° C., and maintained at 56 for an additional 2 hours at a stirring rate of about 180 to 200 revolutions per minute. The mixture was then allowed to cool to room temperature overnight, reference Example Ill. The product (toner throughout) was filtered off, washed twice with deionized water, and freeze dried to afford 260 grams of toner, with a particle size of 5.5 microns with a GSD of 1.25, as measured by the Coulter Counter. The toner was comprised of 3.3% by weight of Pigment Blue 15:3, 62.2% by weight of a first polyester core resin of the berylium salt complex of copoly (1,2-propylene-dipropylene-5-Sulfoisophtalate)-copoly (1,2-propylene-dipropylene terephthalate), and 34.7% by weight of a shell comprised of a second polyester resin of the vanadium salt of copoly (1,2-propylene-dipropylene-5-Sulfoisophtalate)-copoly (1,2-propylene-dipropylene terephthalate).

COMPARATIVE EXAMPLE

A 7.2 Micron Cyan Toner Comprised of 96.7 Percent by Weight of the Polyester Resin, Poly (Bisphenol A-fumarate) and 3.3% Pigment Blue 15:3. (no a Core-Shell Morpthology)

Three hundred (300) grams of the polyester resin poly (bisphenol A-fumarate), obtained from Reichold Chemicals, was dry-blended with 3.3 percent by weight of Pigment Blue 15:3 using a jar mill. The resulting blended mixture was then extruded through an APV 15 millimeters twin screw extruder, which were set at 330° F. The extrudate strand from the extruder die was cooled in a water bath and the solid strands resulting were air-dried and then crushed into fine particles (95 percent by weight passing through 3.36 millimeters sieve) of less than about 3 millimeters in dimension. The resulting crushed toner particles were then ground into fine toners using a jet mill (0202 Jet-O-Mizer), which toner was then classified using an A12 ACUCUT Classifier. The resulting toner product was comprised of 96.7 percent by weight of the above polyester and 3.3 percent of Pigment Blue 15:3. The volume median diameter of the toner product was 7.2 microns with 11 percent by number of fines being between 1.2 to 4 microns.

Fusing Properties

Standard fusing properties of the toner compositions were evaluated as follows: unfused images of toner on paper with a controlled toner mass per unit area of 1.0 milligrams/cm$^2$ were produced by one of a number of methods. A suitable electrophotographic developer was produced by mixing from 2 to 10 percent by weight of the above prepared toners with a suitable electrophotographic carrier of a 90 micron diameter ferrite core, spray coated with 0.5 weight percent of a terpolymer of poly(methyl methacrylate), styrene, and vinyltriethoxysilane, and roll milling the mixture for 10 to 30 minutes to produce a tribarge of between −5 to −20 microcoulombs per gram of toner as measured with a Faraday Cage. The developer was then introduced into the small electrophotographic copier Mita DC-111 in which the fuser system had been disconnected. Between 20 and 50 unfused images of a test pattern of a 65 millimeters by 65 millimeters square solid area were produced on 8 ½ by 11 inch sheets of a typical electrophotographic paper such as Xerox Image LX© paper.

The unfused images were then fused by feeding them through a hot roll fuser system consisting of a fuser roll and pressure roll with VITON surfaces, both of which were heated to a controlled temperature. Fused images were produced over a range of hot roll fusing temperatures of from about 100° C. to about 210° C. The toners as prepared in Example II to VII were evaluated and the characteristics thereof are provided in Table I. The gloss of the fused images was measured according to TAPPI Standard T480 at a 750° angle of incidence and reflection using a NOVO-GLOSS© Statistical Glossmeter, Model GL-NG1002S from Paul N. Gardner Company, Inc. The degree of permanence of the fused images was evaluated by the known Crease Test. The fused image was folded under a specific weight with the toner image to the inside of the fold. The image was then unfolded and any loose toner wiped from the resulting Crease with a cotton swab. The average width of the paper substrate which shows through the fused toner image in the vicinity of the Crease was measured with a custom built image analysis system.

TABLE I

| Toner ID | Peak Gloss $G_{max}$ | COT (° C.) | HOT (° C.) | Crease $T(C_{60})$ | Temp. (° C.) $T(C_{30})$ |
|---|---|---|---|---|---|
| Comparative Example | 65 | 120 | >210 | 146 | 152 |
| Example II | 75 | 110 | >210 | 127 | 131 |
| Example III | 12 | 110 | 200 | 128 | 132 |
| Example IV | 14 | 115 | 210 | 125 | 130 |
| Example V | 30 | 110 | 200 | 130 | 135 |
| Example VI | 35 | 120 | 195 | 138 | 144 |
| Example VII | 35 | 120 | 195 | 139 | 144 |

Paper: 4024
TMA (Toner Mass per Area) = 1.0 mg/cm$^2$
COT = Cold Offset Temperature
HOT = Hot Offset Temperature
$T(G_{50})$ = Fusing Temp. required to reach Gloss 50 gu
$T(C_{30})$ = Fusing Temp. required to reach Fix CA = 30
Peak gloss measurements according to TAPPI T480 (75° C.)
T—Minimum Fixing Temperature The toner fixing of Example II to VII is lower than the toner of the Comparative Example, hence less energy is utilized by the xerographic fuser when the inventive toners are utilized. Furthermore, the gloss temperatures of Example II to Vil can be varied from about 12 to 75, and controlled by the ratio of shell to core, for example, in Example II, the shell content is 13.7 percent by weight, and the resulting gloss is high such as about 75. In Example IIIl or IV, the shell content is high, such as about 55 percent by weight, and low gloss such as from about 12 to 14 is obtained. Hence, the above toners of the present invention provide low minimum fixing temperature such as from about 130 to about 145 degrees centigrade, and variable gloss such as from about 12 to about 75, by varying the ratio amount of shell to core.

Other embodiments and modifications of the present invention may occur to those skilled in the art subsequent to a review of the information presented herein, these embodiments and modifications, as well as equivalents thereof, are also included within the scope of this invention.

What is claimed is:

1. A toner comprised of a core comprised a first resin and colorant, and thereover a shell comprised of a second resin and wherein said first resin is an ion complexed sulfonated polyester resin, and said second resin is a transition metal ion complex sulfonated polyester resin.

2. A toner in accordance with claim 1 wherein said first resin is present in an amount of from about 40 to about 90 percent by weight of toner, and the second resin is present in an amount of from about 10 to about 55 percent by weight of toner and wherein the shell encapsulates said core.

3. A toner in accordance with claim 1 wherein the first resin is of the formula

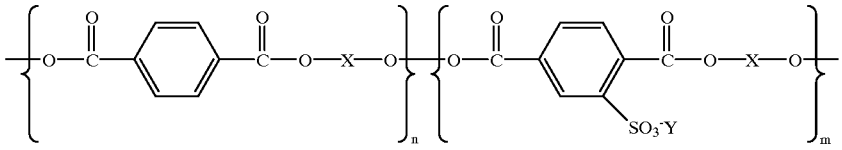

wherein Y is an alkali metal, X is a glycol, and n and m represent the number of segments.

4. A toner in accordance with claim 1 wherein the second resin is of the formula

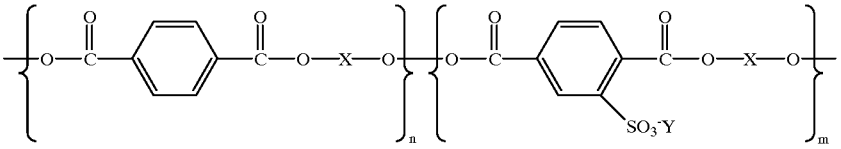

wherein Y is transition metal of a monovalent or multivalent ion of scandium, yttrium, lutertium, titanium, zirconium, hafnium, vanadium, chromium, niobium, tantalum, molybdenum, tungsten, manganese, rhenium, iron, ruthenium, osmium, cobalt, rhodium, iridium, nickel, paladium, copper, platinum, silver, gold, zinc, cadmuim, mercury, aluminum, or mixtures thereof; X is a glycol, and n and m represent the number of segments.

5. A toner in accordance with claim 3 wherein the glycol is neopentyl glycol, ethylene glycol, propylene glycol, butylene glycol, propanediol, diethylene glycol, or mixtures thereof.

6. A toner in accordance with claim 3 wherein said Y alkali is magnesium.

7. A toner in accordance with claim 4 wherein said Y metal is zinc.

8. A toner in accordance with claim 1 wherein the colorant is a cyan, black, magenta, yellow dispersion or mixtures thereof with from about 20 to about 60 weight percent solids of colorant.

9. A toner in accordance with claim 1 wherein said colorant is carbon black.

10. A toner in accordance with claim 1 wherein said colorant is a dye.

11. A toner in accordance with claim 1 wherein said colorant is a pigment.

12. A toner in accordance with claim 1 wherein said colorant is comprised of a mixture of a pigment and a dye.

13. A toner in accordance with claim 1 wherein said first resin is the magnesium salt of copoly (1,2-propylene-dipropylene-5-Sulfoisophtalate)-copoly (1,2-propylene-dipropylene terephthalate), the magnesium salt of copoly (1,2-propylene-diethylene-5-Sulfoisophtalate)-copoly (1,2-propylene-diethylene terephthalate), the calcium salt of copoly (1,2-propylene-dipropylene-5-Sulfoisophtalate)-copoly (1,2-propylene-dipropylene terephthalate), or the barium salt of copoly (1,2-propylene-diethylene-5-Sulfoisophtalate)-copoly (1,2-propylene-diethylene terephthalate).

14. A toner in accordance with claim 1 wherein said second resin is the zinc salt of copoly (1,2-propylene-diethylene-5-Sulfoisophtalate)-copoly (1,2-propylene-diethylene terephthalate), the zince salt of copoly (1,2-propylene-diethylene-5-Sulfoisophtalate)-copoly (1,2-propylene-diethylene terephthalate), the vanadium salt of copoly (1,2-propylene-dipropylene-5-Sulfoisophtalate)-copoly (1,2-propylene-dipropylene terephthalate), or the copper salt of copoly (1,2-propylene-diethylene-5-Sulfoisophtalate)-copoly (1,2-propylene-diethylene terephthalate).

15. A toner in accordance with claim 1 wherein said toner contains in the shell additives comprised of metal salts, metal salts of fatty acids, colloidal silicas, metal oxides, or mixtures thereof which additives are each optionally present in an amount of from about 0.1 to about 2 weight percent.

16. A toner in accordance with claim 3 wherein said glycol, is an aliphatic glycol of neopentyl glycol, ethylene glycol, propylene glycol, butylene glycol, pentylene glycol, propanediol, 1,2-propanediol, diethylene glycol, or mixtures thereof; and n and m represent each is about 10 to about 30 each, and wherein the weight average molecular weight of said polyester is from about 2,000 grams per mole to about 100,000 grams per mole, the number average molecular weight is from about 1,000 grams per mole to about 50,000 grams per mole, and the polydispersity thereof is from about 2 to about 18 as measured by getpermeation chromatography.

17. A toner in accordance with claim 1 wherein said first resin is the magnesium salt of copoly (1,2-propylene-dipropylene-5-sulfoisophtalate)-copoly (1,2-propylene-dipropylene terephthalate).

18. A toner in accordance with claim 1 wherein said second resin is the zinc salt of copoly (1,2-propylene-diethylene-5-Sulfoisophtalate)-copoly (1,2-propylene-diethylene terephthalate).

19. A toner comprised of a resin core and colorant, and a resin shell and wherein said core resin is an alkali polyester resin, and said resin shell is a transition metal polyester resin.

20. A toner in accordance with claim 19 wherein said core resin is an alkali complexed sulfonated polyester and said resin shell is a transition metal ion complex of a sulfonated polyester resin.

21. A toner comprised of a core comprised a first resin and colorant, and a second resin shell wherein said first resin is of the formula

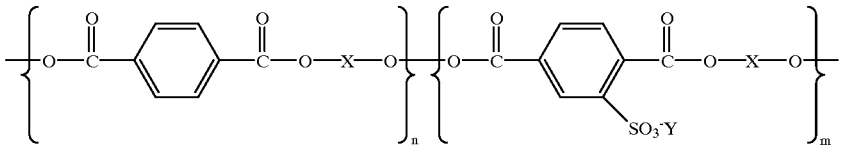

wherein Y is an alkali metal, X is a glycol, and n and m represent the number of segments, and said second said resin is a transition metal ion complex sulfonated polyester resin

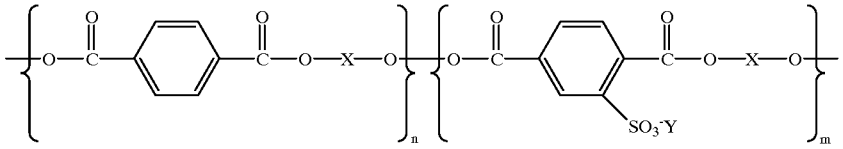

and wherein Y is a monovalent transition metal, or a divalent transition metal, x is a glycol and n and m represent the number of segments.

22. A toner in accordance with claim 1 wherein the toner particle size is from about 3 to about 15 microns in volume average diameter.

23. A toner in accordance with claim 3 wherein said Y alkali metal is a magnesium ($Mg^{++}$), berylium ($Be^{++}$), calcium ($Ca^{++}$) or Barium ($Ba^{++}$); and wherein each n and m is a number of from about 10 to about 30, and wherein the weight average molecular weight thereof of said core resin is from about 2,000 grams per mole to about 100,000 grams per mole, the number average molecular weight is from about 1,000 grams per mole to about 50,000 grams per mole, and the polydispersity is from about 2 to about 18 as measured by gel permeation chromatography.

24. A toner accordance with claim 3 wherein X is aliphatic glycol of neopentyl glycol, ethylene glycol, propylene glycol, butylene glycol, pentylene glycol, propanediol, 1,2-propanediol, diethylene glycol, or mixtures thereof.

25. A toner process comprising (I) admixing an alkali metal sodio sulfonated polyester resin, colorant; and add a transition metal sodio sulfonated polyester and optionally adding to said toner wax, charge additive, and surface flow additives.

26. A toner process comprising (I) preparing a colloidal solution of a sodio sulfonated polyester resin by heating said solution at a temperature of from about 75 to about 95 degrees Centigrade; adding thereto a sodio sulfonated polyester; cooling; adding thereto a colorant, followed by heating the resulting mixture and adding thereto an aqueous solution containing an alkali (II) salt; adding a further amount of colloidial sulfonated polyester resin, followed by the addition of an aqueous solution of a transition metal salt solution; isolating said toner resulting, and drying said toner.

27. A process in accordance with claim 25 wherein said toner is isolated, filtered, washed with water, and dried.

* * * * *